United States Patent [19]

Larsson

[11] Patent Number: 4,861,209

[45] Date of Patent: Aug. 29, 1989

[54] THREADED COUPLING

[75] Inventor: Kenneth L. Larsson, Sandviken, Sweden

[73] Assignee: Sandvik AB, Sandviken, Sweden

[21] Appl. No.: 73,801

[22] Filed: Jul. 14, 1987

[30] Foreign Application Priority Data

Jul. 15, 1986 [SE] Sweden ..... 8603118

[51] Int. Cl.[4] ..... F16B 35/04; F16L 15/00

[52] U.S. Cl. ..... 411/411; 411/366; 403/307; 285/390

[58] Field of Search ..... 411/411, 414, 416, 379, 411/382, 366, 436; 403/307, 343; 285/390

[56] References Cited

U.S. PATENT DOCUMENTS 1,953,095 4/1934 Baker ..... 403/307
3,586,353 6/1971 Lorenz ..... 285/390
3,645,570 2/1972 Johansson et al. ..... 403/307
4,295,751 10/1981 Holmberg ..... 285/390

FOREIGN PATENT DOCUMENTS 629837 9/1949 United Kingdom ..... 285/390

*Primary Examiner*—Neill R. Wilson
*Attorney, Agent, or Firm*—Burns, Doane, Swecker & Mathis

[57] ABSTRACT

A threaded coupling for a high frequency percussion drill assembly comprises a rod and a sleeve having external and internal threads, respectively. The threads are of the asymmetrical type and make contact along opposing shoulder portions disposed on only one side of each crown portion. The threads have a maximum diameter from 30 to 40 mm, a pitch of 7 to 11 mm, and a height from 1.2 to 1.6 mm. The parts of the root and crown portions located immediate adjacent the contacting shoulder portions have radii from 3 to 5 mm.

5 Claims, 4 Drawing Sheets

THREADED COUPLING

BACKGROUND OF THE INVENTION

The present invention relates to a threaded coupling having a diameter in the interval of 30 to 40 mm adapted for percussion drill rods and comprising an external thread on the rod and an internal thread in the sleeve, the threads both of the rod and the sleeve having continuously curved tops and bottoms in the longitudinal section of said threads.

In drill steel couplings a type of rope thread called the R16-profile has been used for a long time. In equipment for drifter drilling it is totally dominating.

The R16-profile has a good fatigue resistance in combination with a satisfying wearability thanks to the rounded shape of tops and bottoms of the thread.

It has however turned out that the R16-profile does not function in a satisfying way together with the high frequency percussive drilling machines that have been developed during recent years.

The problem is that the thread coupling due to the high percussion frequency does not stay sufficiently tightened during work. This means that the degree of efficiency for the energy of the shock wave decreases and so-called pittings develop on the contact surfaces of the thread. These pittings do eventually lead to a fatigue fracture.

The aim of the invention is thus to prevent a thread coupling that remains sufficiently tightened during work without deteriorating the good characteristics in fatigue resistance and wearability.

THE DRAWINGS

Below, an embodiment of the invention will be described with reference to the accompanying drawings where FIGS. 1*a* and 1*b* disclose certain geometric parameters in connection with threads; FIG. 2 discloses schematically the geometry of a so-called rope thread; FIGS. 3*a* and 3*b* disclose a diagram of how the tightening capacity varies with the pitch and the shoulder angle.

DESCRIPTION OF A PREFERRED EMBODIMENT OF THE INVENTION

When designing the concept to be valid for a thread coupling according to the present invention the following has been taken into consideration.

The tightening capacity of a thread can be defined as the ratio between the uncoupling torque, MU, and the tightening torque, MT.

For an arbitrary thread the following is valid:

$$\frac{MU}{MT} = \frac{\dfrac{S\cos(\beta/2) - \mu\,\pi\,D_m}{\pi\,D_m\cos(\beta/2) + \mu\,S} - \mu\dfrac{d_m}{D_m}}{\dfrac{S\cos(\beta/2) + \mu\,\pi\,D_m}{\pi\,D_m\cos(\beta/2) - \mu\,S} + \mu\dfrac{d_m}{D_m}} \quad (1)$$

where $s$ = the pitch $\beta/2$ = the shoulder angle $D_m$ = average diameter of thread $$= \frac{D_yM + D_iF}{2}$$

-continued $d_m$ = average diameter of the end of the rod $$= \frac{d_y + d_i}{2}$$

$\mu$ = friction coefficient that is assumed to be the same in the thread coupling and in the contact surface of the end of the rod.

Figure 1A:
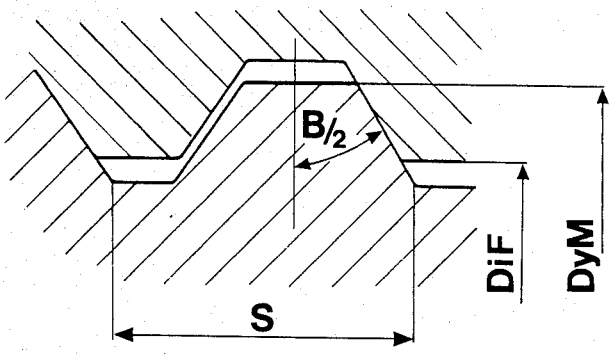
Fig.1a (PRIOR ART)
Figure 1B:
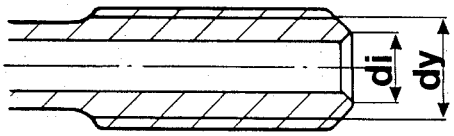
Fig.1b (PRIOR ART)
Figure 2:
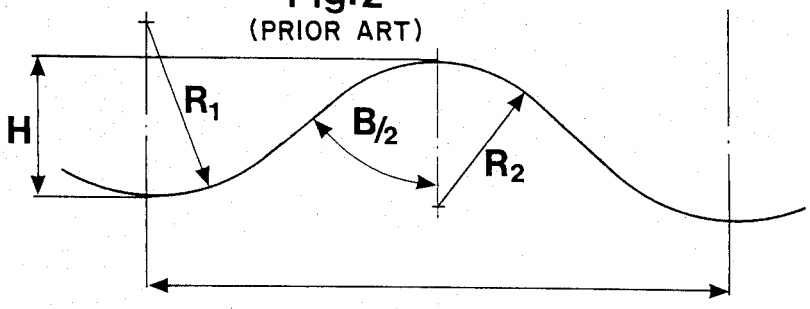
Fig.2 (PRIOR ART)

The geometric quantities of the formula (1) are disclosed in FIGS. 1*a* and 1*b*. A characterizing feature for rope threads is that they have a constant radius of curvature both at the thread top and its bottom. In FIG. 2 these constant radii of curvature are designated by $R_1$ and $R_2$, respectively.

From FIG. 2 the following formula can be learnt:

$$(H-R_1-R_2)\sin(\beta/2) - S/2\cos(\beta/2) + R_1 + R_2 = 0 \quad (2)$$

where

H = the thread height

S = the pitch $\beta/2$ = the shoulder angle

By combining the formulas (1) and (2) it is possible to optimize the tightening capacity $$\frac{MU}{MT}$$

for a rope thread. For a known rope thread having so-called R16-profile and a diameter of 38 mm a value for $$\frac{MU}{MT}$$

=0.66 is achieved if the formulas (1) and (2) are combined and $\mu$ is given the value of 0.2 that empirically has been found to be a normal value for threaded drill steel couplings.

The primary aim of the present invention is thus to increase the tightening capacity of a thread coupling, i.e.

$$\frac{MU}{MT}$$

shall relatively seen have as high a value as possible. However, in order not to affect, to a too great extent, the characteristics concerning fatigue resistance and wearability in a negative way, one must also consider the relative magnitude of the height and radius of curvature of the thread.

Figure 3A:
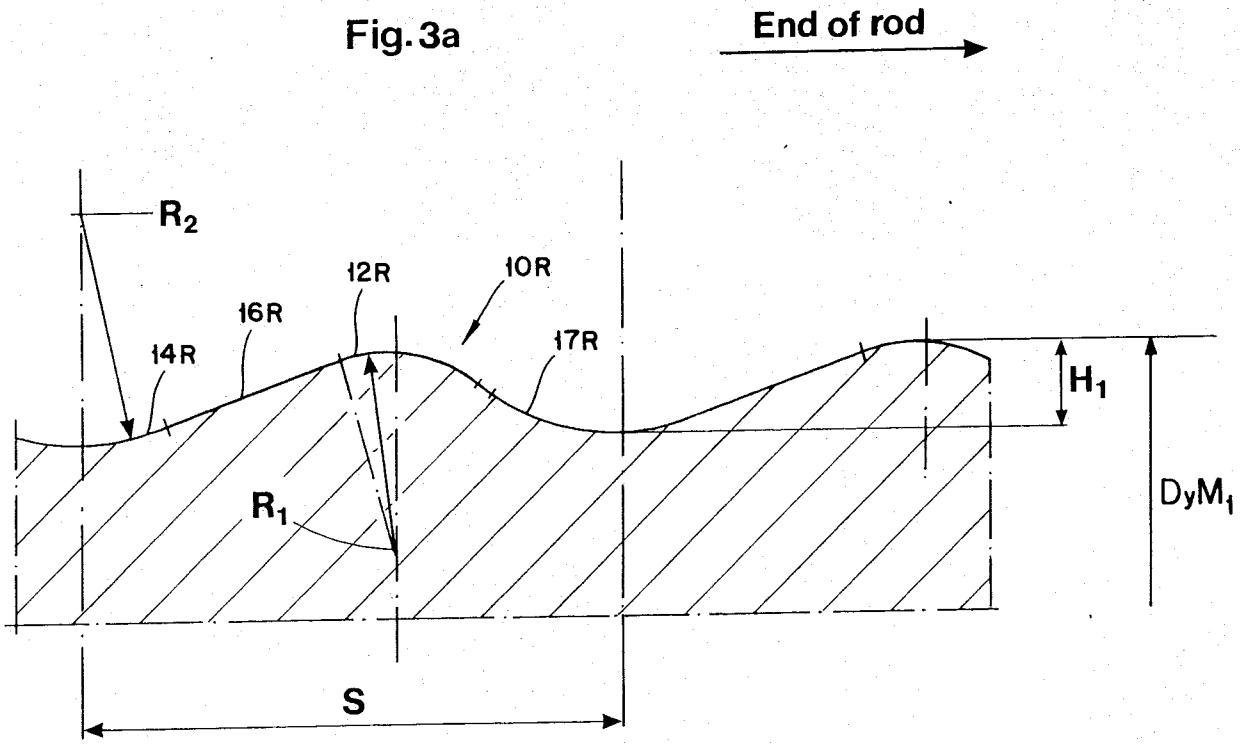
Figure 3B:
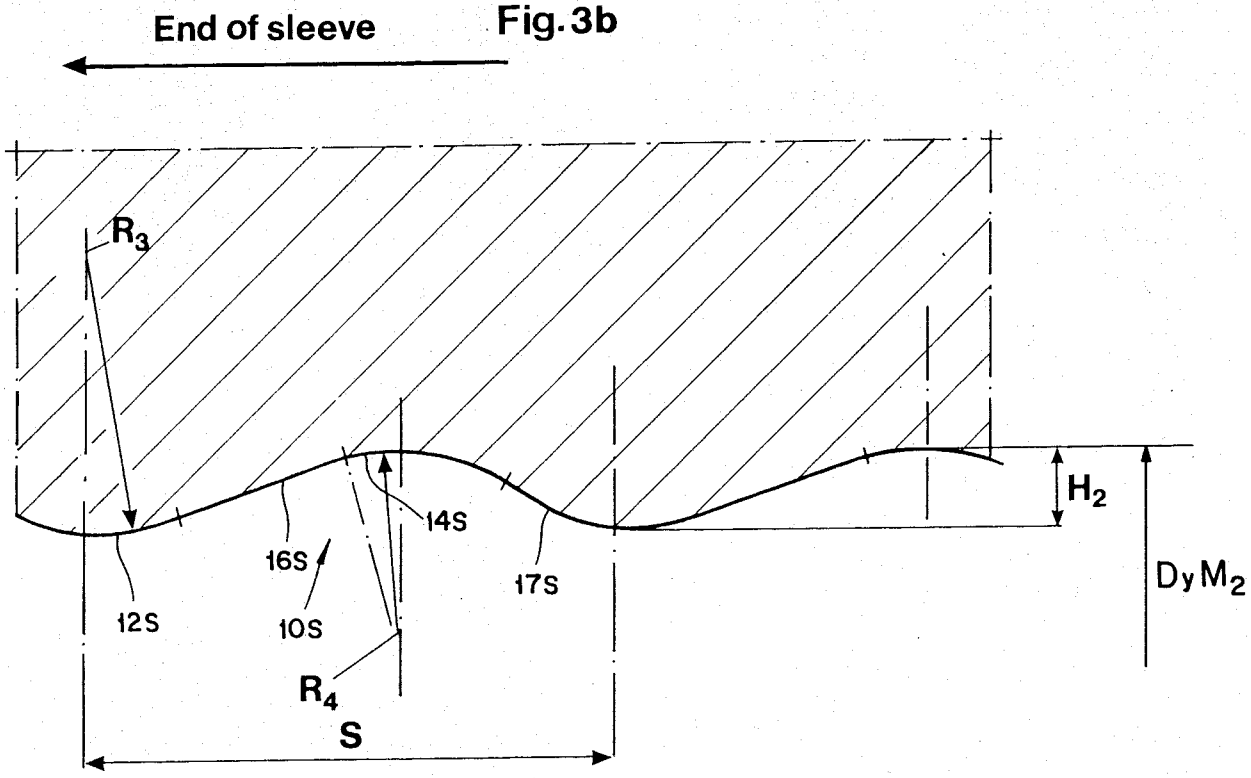

The embodiment according to FIGS. 3*a* and 3*b* refers to a so-called asymmetrical thread, the thread coupling having a maximum diameter DyM of 38 mm.

Although the above disclosed formula (2) refers to rope threads the ideas of the present invention also are applicable in an asymmetrical thread coupling according to FIGS. 3*a* and 3*b*. The reason for that is that contact only is present along one 16R, 16S of the thread shoulders 16R, 16S, 17R, 17S that are located on both sides of each top or bottom of each thread, respectively. In the disclosed embodiment contact will be present only along the shoulder that is most leveled, i.e. has the smallest inclination, said shoulder and the adjacent portion of the adherent top and bottom up to its highest and lowest point, resp., constitute "half" a rope thread. Since a decreased pitch generally seen leads to a higher value of the tightening property $$\left(\frac{MU}{MT}\right),$$

the shoulder that has no contacting function in the thread coupling is made as short as possible. Compared to a conventional rope thread the asymmetrical thread according to FIGS. 3*a* and 3*b* has the advantage of a relatively seen smaller pitch S that leads to a better tightening property than a conventional rope thread having the same parameters for the working thread shoulder, i.e. where contact is present.

For the embodiment according to FIGS. 3*a* and 3*b* the external thread on the rod 10R according to FIG. 3*a* has a height $H_1$ equal to 1.50 mm, the pitch S is equal to 9.28 mm, the radius of curvature $R_1$ for the top or crown 12R of the thread is 3.5 mm, and the radius of curvature $R_2$ for the bottom or root 14R of the thread is 4.0 mm.

The internal thread of the sleeve 10S according to FIG. 3*b* has a height $H_2$ of 1.435 mm, a pitch S of 9.28 mm, a radius of curvature $R_3$ for the top 12S of thread of 5.0 mm, and a radius of curvature $R_4$ for the bottom 14S of the thread of 3.5 mm.

Figure 4:
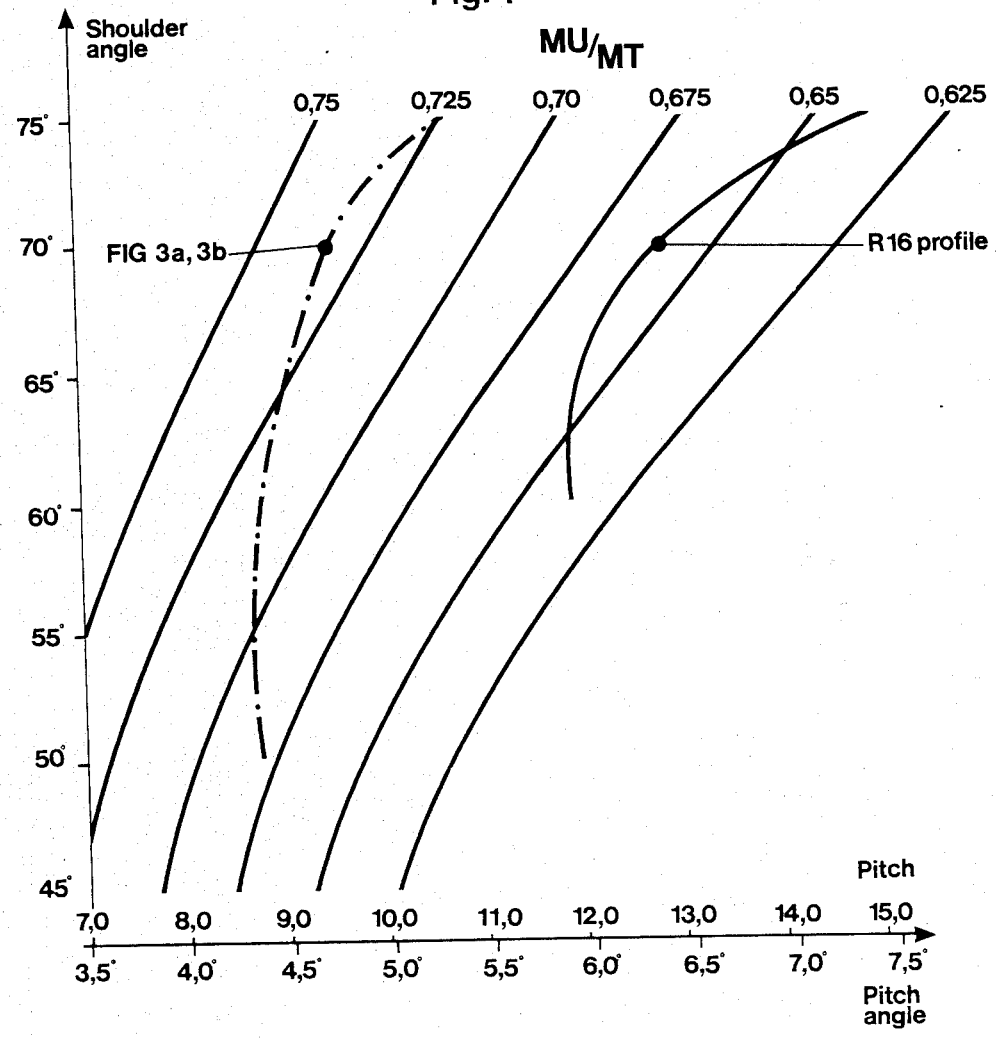

The diagram of FIG. 4 discloses how the tightening capacity $$\left(\frac{MU}{MT}\right)$$

varies with the parameters for pitch S and shoulder angle, said angle in itself including the parameters of radius of curvature and height.

In FIG. 4 the tightening capacity $$\left(\frac{MU}{MT}\right)$$

has been calculated for different values of pitch and shoulder angle; each curve (continuous or dotted) refers to constant radii of curvature that coincide with the radii of curvature both for the known thread so-called R16-profile as well as for the new threads according to FIGS. 3*a* and 3*b* in the present application. In this connection it has been assumed that $\mu=0.2$.

The points inserted in FIG. 4 correspond to the values of pitch and shoulder angle that the R16-profile and the threads according to FIGS. 3*a* and 3*b* have been given. It should be noticed that the intention is to be located in the area of the curve where the tightening capacity $$\left(\frac{MU}{MT}\right)$$

is as high as possible.

I claim:

1. A threaded coupling for a high-frequency percussion drill assembly comprising a rod and a sleeve, said rod comprising an external thread having continuously curved crown and root portions interconnected by shoulder portions, said sleeve comprising an internal thread having continuously curved crown and root portions interconnected by shoulder portions arranged to oppose respective ones of said shoulder portions of said external thread, said internal and external threads each being of asymmetrical configuration so as to make contact along opposing shoulder portions disposed on only one side of each crown portion, said external thread having a maximum diameter in the range of 30 to 40 mm, a pitch in the range of 7 to 11 mm, and a height in the range of 1.2 to 1.6 mm, the parts of said root and crown portions located immediately adjacent the contacting shoulder portions having radii in the range of 3 to 5 mm, said internal thread having a maximum diameter in the range of 30 to 40 mm, a pitch in the range of 7 to 11 mm, and a height in the range of 1.2 to 1.6 mm, and the parts of said root and crown portions located immediately adjacent the contacting shoulder portions having radii in the range of 3 to 5 mm.

2. A threaded coupling according to claim 1, wherein said pitch of said internal and external threads is in the range of 8 to 10 mm.

3. A threaded coupling according to claim 1, wherein said height of said internal and external threads is in the range of 1.3 to 1.5 mm.

4. A threaded coupling according to claim 1, wherein said internal and external threads have a pitch in the range of 9.2 to 9.3 mm, and a height in the range of 1.4 to 1.5 mm, and a radius of curvature of said parts of said root and crown portions being in the range of 3.5 to 5 mm.

5. A threaded coupling according to claim 4, wherein said maximum diameter of said internal and external threads is 38 mm.

* * * * *